US009493958B1

(12) United States Patent
Taylor

(10) Patent No.: US 9,493,958 B1
(45) Date of Patent: Nov. 15, 2016

(54) WEDGE-ACTIVATED ROD CLAMP ASSEMBLY

(71) Applicant: Denzel K. Taylor, Crown Point, IN (US)

(72) Inventor: Denzel K. Taylor, Crown Point, IN (US)

( * ) Notice: Subject to any disclaimer, the term of this patent is extended or adjusted under 35 U.S.C. 154(b) by 0 days.

(21) Appl. No.: 15/019,191

(22) Filed: Feb. 9, 2016

(51) Int. Cl.
*E04G 17/07* (2006.01)
*E04G 17/04* (2006.01)

(52) U.S. Cl.
CPC ..... *E04G 17/0735* (2013.01); *E04G 17/045* (2013.01); *E04G 17/07* (2013.01)

(58) Field of Classification Search
CPC ..... E04G 17/02; E04G 17/06; E04G 17/045; E04G 17/07; E04G 17/0735
USPC ..... 249/45, 46, 191, 213, 216, 219.1; 403/314, 324, 393, 396, 409.1
See application file for complete search history.

(56) References Cited

U.S. PATENT DOCUMENTS 302,519 A * 7/1884 Parsons ..... B60D 1/02 278/65
526,123 A * 9/1894 Boots ..... F16B 7/0433 403/396
748,056 A * 12/1903 Dulinsky ..... F16G 11/04 403/314
1,251,256 A * 12/1917 Lynch ..... B25B 5/102 24/132 R
1,348,060 A * 7/1920 Sheppard ..... E01C 19/502 238/315
1,379,457 A 5/1921 Loxterman
1,387,766 A * 8/1921 Colt ..... E04G 17/0707 24/19
1,438,250 A * 12/1922 Lyon ..... B23Q 3/108 269/234
1,513,199 A * 10/1924 Tompkins ..... E21B 17/02 403/304
1,561,923 A * 11/1925 Heltzel ..... E01C 19/502 249/6
1,634,422 A * 7/1927 Holmes ..... E04G 17/075 24/136 R
1,651,787 A 12/1927 Venable
1,827,672 A 10/1931 Rogers
1,875,366 A * 9/1932 Beghetti ..... E04G 17/07 249/216
1,936,740 A 11/1933 Wolf
2,162,349 A * 6/1939 Hillberg ..... E04G 17/0707 24/268
2,171,524 A * 9/1939 Gates ..... E04G 17/0714 24/136 R
2,338,025 A * 12/1943 Cooper ..... E04G 17/06 249/213
2,395,204 A * 2/1946 Symons ..... E04G 17/0754 24/135 N
2,433,934 A * 1/1948 Symons ..... E04G 17/0721 249/190
2,661,516 A 2/1950 Yates
2,507,061 A * 5/1950 Symons ..... E04G 17/0754 24/1
2,663,925 A 6/1950 Yates
2,584,822 A * 2/1952 Symons ..... E04G 17/0721 249/190
2,640,249 A 6/1953 Symons
2,640,448 A * 6/1953 Roberts ..... D05B 35/062 112/152
2,816,345 A * 12/1957 Symons ..... E04G 11/10 249/191
3,103,730 A * 9/1963 Carlton ..... E04G 17/0714 249/191
3,648,962 A 3/1972 Farley
3,724,806 A 4/1973 Shoemaker (Continued)

*Primary Examiner* — Michael Safavi
(74) *Attorney, Agent, or Firm* — Hartman Global IP Law; Gary M. Hartman; Michael D. Winter

(57) ABSTRACT

A rod clamp assembly and method for securing a rod. The assembly includes a housing and wedge member. The housing has an oppositely-disposed pair of sidewalls and an oppositely-disposed pair of endwalls. The sidewalls have a side passage that passes through the housing and defines an interior cavity within the housing. The endwalls have an end passage that passes through the housing and its cavity. The end passage includes at least two end passage walls within the housing, each end passage wall being between the cavity and one of the endwalls. The end passage has a cross-sectional shape defined at least in part by two opposing series of holes that increase in diameter toward the cavity, resulting in each of the end passage walls comprising a series of steps. The wedge member has a cross-sectional shape that enables the wedge member to be inserted through the side passage.

20 Claims, 4 Drawing Sheets

(56) References Cited

U.S. PATENT DOCUMENTS 3,835,610 A * 9/1974 Harper ..... F16B 12/24 403/171
3,917,216 A 11/1975 Plough
4,208,030 A * 6/1980 Wilson ..... E04G 17/0721 249/190
4,221,357 A * 9/1980 Bowden ..... E04G 17/0742 249/190
4,473,209 A * 9/1984 Gallis ..... E04G 9/02 249/191
4,579,312 A 4/1986 White
4,695,178 A * 9/1987 Era ..... E04C 5/163 403/14
4,712,764 A 12/1987 White
5,127,763 A * 7/1992 Kunoki ..... F16B 2/14 403/314
5,251,868 A 10/1993 Trimmer et al.
5,261,635 A 11/1993 Flathau
5,265,836 A 11/1993 Dale
5,556,224 A * 9/1996 Niskanen ..... F16B 7/0413 403/324
5,888,015 A * 3/1999 Brown ..... F16B 7/1454 403/374.1
6,234,465 B1 5/2001 Sutton, Jr.
6,905,106 B2 6/2005 Myers et al.
8,752,804 B2 6/2014 Taylor

* cited by examiner

WEDGE-ACTIVATED ROD CLAMP ASSEMBLY

BACKGROUND OF THE INVENTION

This invention relates to an apparatus for holding concrete forms together or in place, while concrete is being placed, or for any number or reasons a rod must be held.

Concrete forms are typically held together by standard form ties while placing concrete. Forms are manufactured to have a standard spacing for which the ties are made. If this spacing deviates from the standard spacing, then metal pencil rods and rod clamps are typically used to hold the nonstandard forms together. The rod clamps that are used are conventional and have been in use for many years.

Conventional rod clamps are typically in the form of a metal casting having a hole through which a form tie or pencil rod (hereinafter referred to as rods) can be passed. A bolt is threaded into the casting in a direction perpendicular to the rod, so that the bolt can be tightened to clamp against the rod and secure it in place within the casting. The casting has a flat side adapted to rest against a concrete form and is sufficiently large to prevent the casting from slipping through the form when pressure is applied by the poured concrete. Rod clamps are normally placed on both sides of concrete forms and must be held tight against the form while concurrently tightening the bolt to hold the rod in place. The bolt must be sufficiently tightened to secure the rod, yet not so tight as to sever the rod.

Rod clamps of the type described above are widely used and work well if the bolts are not fouled, such as with concrete or corrosion. However, fouling is inevitable under the conditions in which the clamps are used. Furthermore, the bolt threads can eventually become stripped due to over-tightening or repetitive use. However, damage to the rod and stripping of the bolt threads are often not discovered until the concrete pressure is applied, at which point the clamp is no longer able to secure the forms and the forms give under the pressure from the concrete. If a clamp fails, the forms must be braced in some manner to keep the concrete from bulging the forms.

An alternative to the rod clamp described above comprises a metal piece through which a rod is passed. The metal piece does not use a bolt to secure the rod, but instead uses a notched hinged piece that is adapted to bias against the rod. This type of rod clamp has not been as widely adopted because the notch is prone to wear.

U.S. Pat. No. 8,752,804 to Taylor discloses a rod clamp assembly that provides various advantages over prior rod clamps. The rod clamp assembly includes a housing and a wedge member adapted to be inserted into the housing through at least one side passage that passes through an interior cavity within the housing. The housing further has an end passage that is adapted to receive a rod and intersects the side passage within the housing cavity. After a rod has been inserted into the end passage, the wedge member can be inserted into the side passage so that a ramp feature of the wedge member engages a portion of the rod within the cavity. The end passage has a cross-sectional shape such that the end passage is larger at its intersection with the cavity and the ramp feature of the wedge member causes the rod to bow and engage the walls of the end passage, effectively locking the rod within the housing cavity to secure the rod to the housing.

Though the rod clamp assembly of Taylor provides advantages over prior rod clamps, including its ability to be repetitively reused and resistant fouling, further advancements would be desirable.

BRIEF DESCRIPTION OF THE INVENTION

The present invention provides a rod clamp assembly and method for securing a rod, for example, a form tie or pencil rod used to secure and support concrete forms.

According to a first aspect of the invention, the rod clamp assembly includes a housing and a wedge member. The housing has sidewalls and endwalls. The sidewalls are arranged to define at least a first pair of sidewalls and the endwalls are arranged to define at least one pair of endwalls. The sidewalls of the first pair of sidewalls are oppositely-disposed from each other, and the endwalls of the pair of endwalls are oppositely-disposed from each other. The first pair of sidewalls has a side passage that passes entirely through the housing and defines an interior cavity within the housing. The pair of endwalls has an end passage that passes entirely through the housing and through the cavity within the housing to define an intersection with the cavity. The end passage comprises at least two end passage walls within the housing, each end passage wall being between the cavity and one of the pair of endwalls. The end passage has a cross-sectional shape defined at least in part by two opposing series of holes that increase in diameter toward the cavity, resulting in each of the end passage walls comprising a series of steps and the end passage being larger at the intersection with the cavity than at the endwalls of the housing. The wedge member has a first longitudinal end, an oppositely-disposed second longitudinal end, and at least a first ramp feature at the second longitudinal end that defines an edge that is not parallel to a longitudinal axis of the wedge member. The wedge member has a cross-sectional shape congruous to the cross-sectional shape of the side passage of the housing, and a longitudinal length that is sufficient so that the first ramp feature enters the intersection between the end passage and the side passage when the wedge member is inserted through the side passage of the housing.

Other aspects of the invention include methods of using the rod clamp assembly to secure and support concrete forms.

A technical effect of the invention is the ability of the stepped end passage to provide an increased retention capability while still allowing for repetitive reuse of the assembly. The rod clamp assembly is also resistant to fouling since concrete, sand, dirt, rust and other potential foulants are able to flow completely through the housing and therefore are less likely to be trapped within the housing.

Other aspects and advantages of this invention will be better appreciated from the following detailed description.

DETAILED DESCRIPTION OF THE INVENTION

Figure 7:
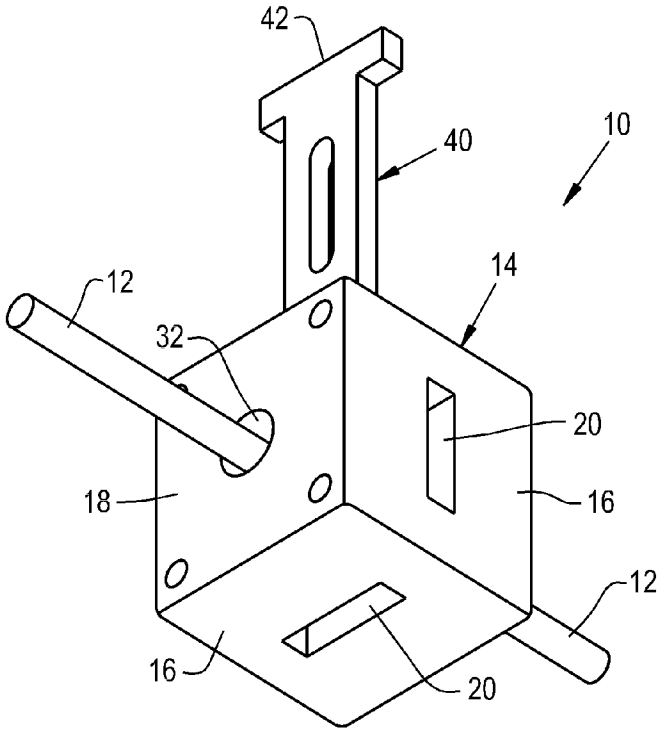
FIGS. 6 and 7 are perspective and end views, respectively, showing the wedge member of FIG. 5 assembled with the rod clamp housing of FIGS. 1 through 4 and securing a rod within the rod clamp housing.
Figure 5:
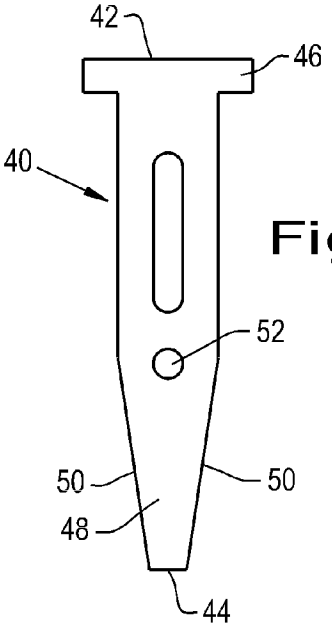
FIG. 5 is a side view of a wedge member adapted for use with the rod clamp housing of FIGS. 1 through 4.
Figure 6:
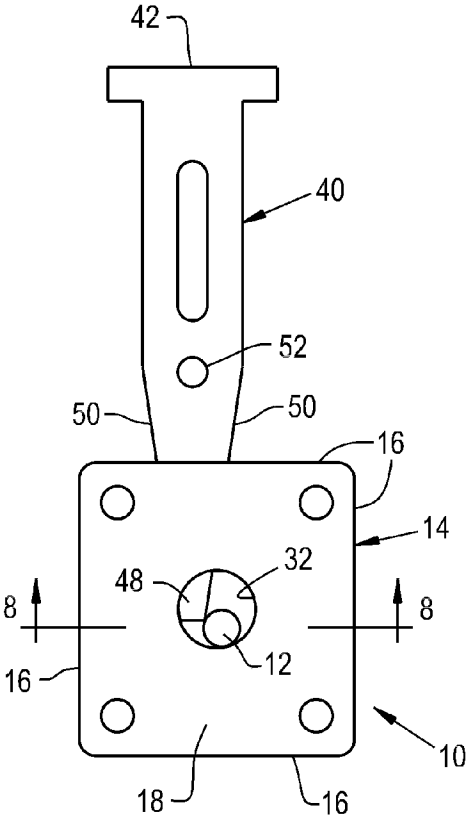
Figure 8:
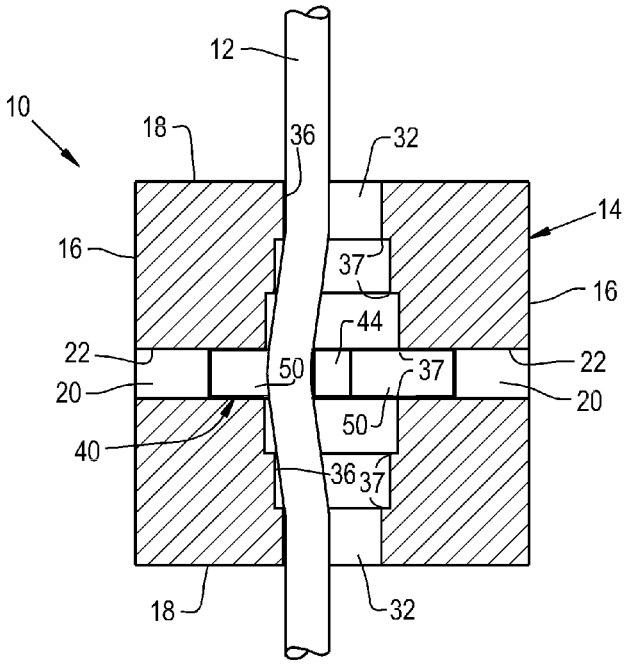
FIG. 8 is a cross-sectional view of the assembly of FIGS. 6 and 7 taken from the section line 8-8 of FIG. 6.

FIGS. 1 through 5 represent components of a rod clamp assembly 10 represented in FIGS. 6 and 7, which is capable of being assembled with a rod 12 to secure the rod 12 as represented in FIGS. 6, 7 and 8. The assembly 10 and rod 12 can be used for a variety of applications, a notable but nonlimiting example of which is to secure and support a concrete form. Rods (form ties) of the type used with concrete forms typically have a circular cross-sectional shape and size to withstand the stresses associated with loads required to support concrete forms. A typical but nonlimiting example is a rod having a diameter of about one-quarter inch (about 6 mm).

Figure 9:
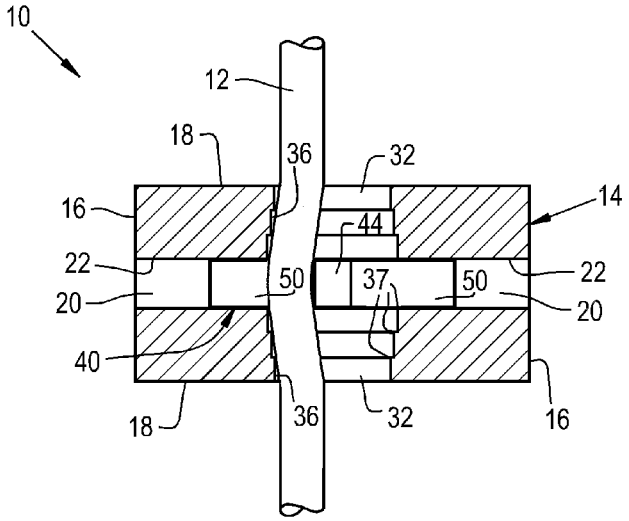
FIG. 9 is a cross-sectional view of an assembly similar to that of FIG. 8, but with a rod clamp housing modified to have an alternative exterior shape.

A rod clamp housing 14 of the rod clamp assembly 10 is represented in FIGS. 1 through 4, a wedge member 40 of the rod clamp assembly 10 is represented in FIG. 5, and FIGS. 6, 7 and 8 represent the housing 14 and wedge member 40 assembled together to secure the rod 12 within the housing 14. The housing 14 can be constructed of various materials using various fabricating processes, including casting, three-dimensional (3D) printing, and the assembly of subcomponents to form the housing 14. Though the housing 14 is not limited to any particular exterior shape, the embodiment of the housing 14 shown in FIGS. 1-4 and 6-8 has a rectangular parallelepiped shape, more specifically a cubic exterior shape. An alternative configuration for the housing 14 is represented in FIG. 9 as a rectangular cuboid, whereby the thickness of the housing 14 between an oppositely-disposed pair of endwalls 18 thereof is roughly half of that represented for the housing 14 shown in FIGS. 1-4 and 6-8. Aside from their different exterior shapes, both versions of the housing 14 shown in the drawings may share essentially identical features, and therefore the same reference numbers will be used throughout this description to refer to features applicable to both versions. Unless otherwise noted, aspects of the embodiment of FIG. 9 that are not discussed in any detail can be, in terms of structure, function, materials, etc., essentially as described for the embodiment of FIGS. 1-4 and 6-8.

Figure 1:
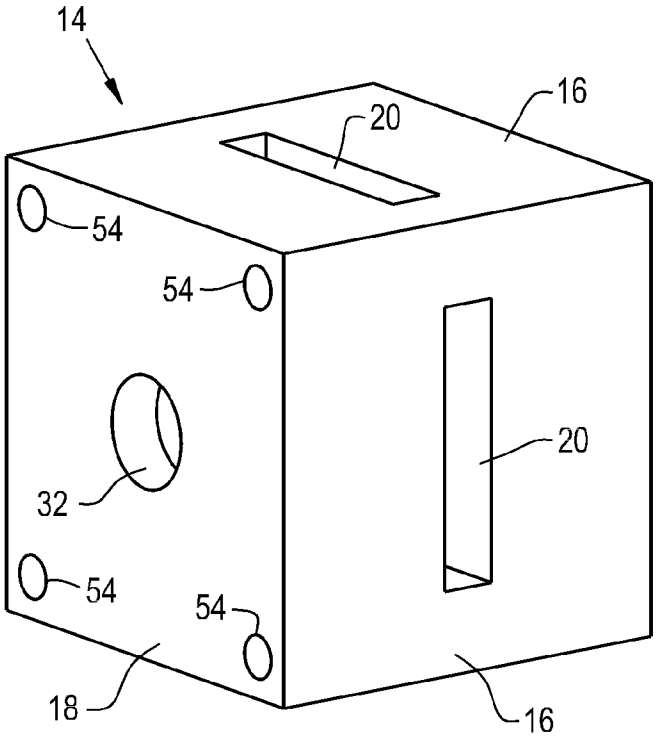
FIGS. 1 and 2 are perspective and top views, respectively, of a rod clamp housing in accordance with a nonlimiting embodiment of this invention.
Figure 2:
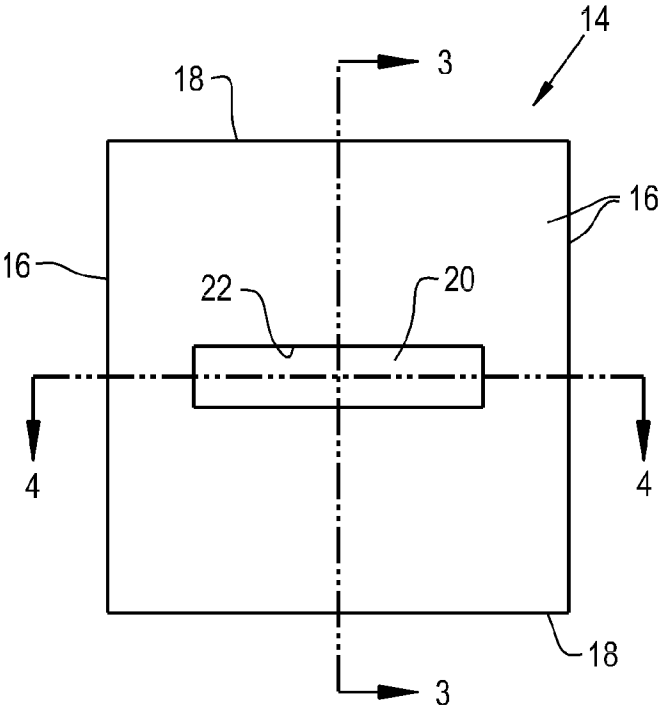
Figure 4:
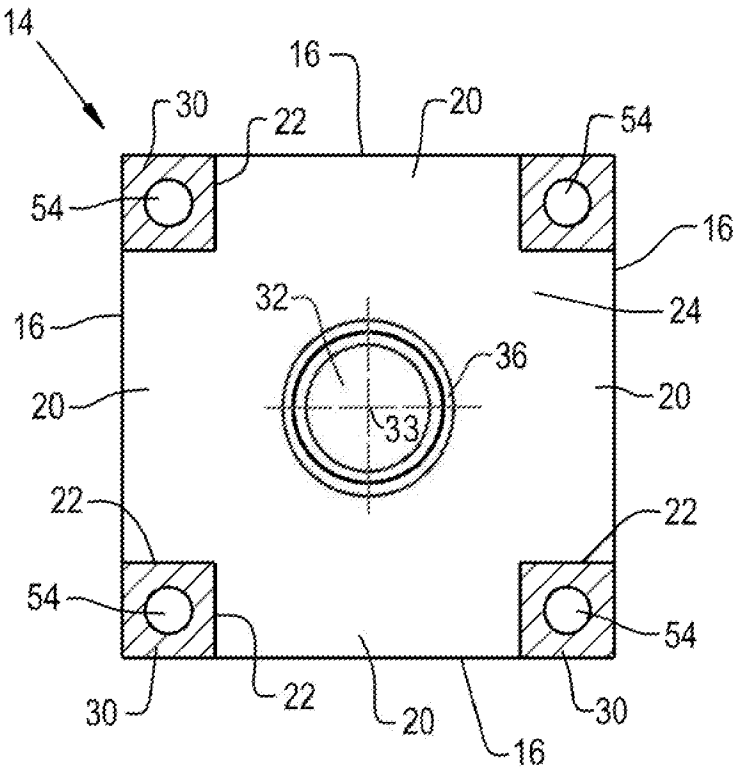
FIGS. 3 and 4 represent cross-sectional views of the rod clamp housing of FIGS. 1 and 2 along section lines 3-3 and 4-4, respectively, of FIG. 2.

In addition to its two endwalls 18, the housing 14 has four sidewalls 16 that are disposed transverse to the endwalls 18. Due to the rectangular parallelepiped shape of the housing 14, the sidewalls 16 are arranged as pairs that are oppositely-disposed from each other, as are the endwalls 18. Each pair of sidewalls 16 has a side passage 20 that passes entirely through the housing 14. Preferably, the side passages 20 have identical (or at least congruous) cross-sectional shapes. In the embodiments shown, the side passages 20 have rectangular cross-sectional shapes that correspond to a preferred (but not required) rectangular cross-sectional shape of the wedge member 40, as evident from FIGS. 8 and 9. Each side passage 20 is defined by side passage walls 22 within the housing 14. The side passages 20 intersect each other to define an interior cavity 24 within the housing 14. As seen in FIG. 4, the cavity 24 generally has a cross shape. From FIGS. 3 and 4, it can be appreciated that the housing 14 can be described as comprising two housing members 26 and 28 that are separated by four pillars 30 located at corners of the housing 14. As such, this configuration enables the housing 14 to be an assembly of discrete subcomponent, for example, the individual housing members 26 and 28 can be discrete subcomponents of the housing 14 and the pillars 30 can be discrete subcomponents of the housing 14 or defined on either or both of the housing members 26 and 28.

Figure 3:
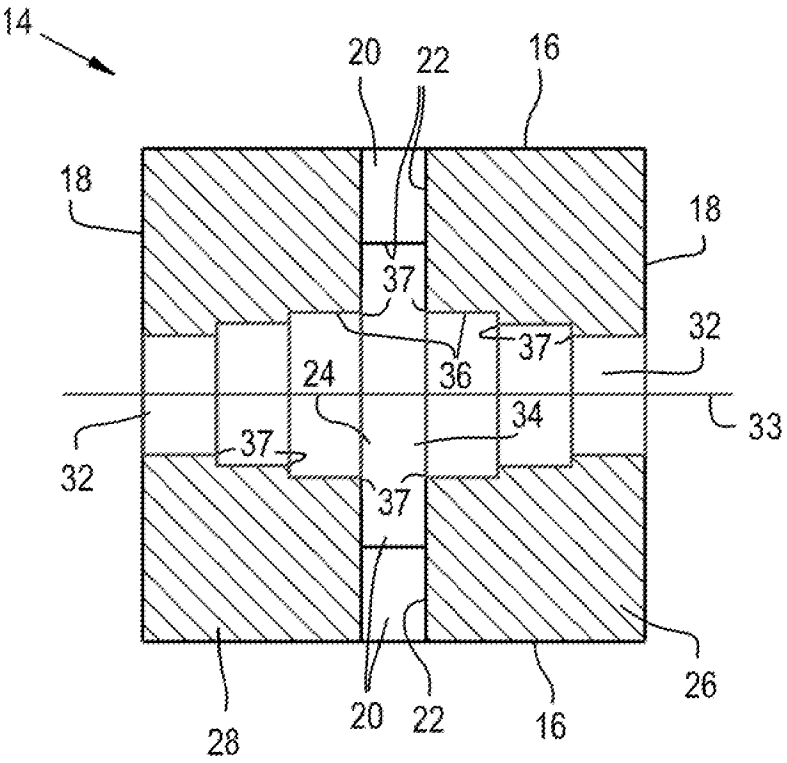

A passage 32 also passes entirely through the housing 14 between the pair of endwalls 18. The passage 32, which may be referred to as an end passage 32, also passes through the cavity 24 within the housing 14 defined by the side passages 20, such that the side and end passages 20 and 32 define an intersection 34 with the cavity 24 (FIG. 3). The end passage 32 is defined by two end passage walls 36 within the housing 14, each end passage wall 36 being between the cavity 24 and one of the endwalls 18. As evident from FIGS. 8 and 9, the end passage 32 has a cross-sectional size and shape for accommodating the rod 12, such that the cross-section of the end passage 32 is larger than that of the rod 12. More particularly, the cross-section of the end passage 32 is shown as increasing in size toward the cavity 24, so that the end passage 32 is larger at its intersection 34 with the housing cavity 24 than at the endwalls 18 of the housing 14. In the drawings, the cross-sectional shapes of the end passage 32 and rod 12 are circular, though it is foreseeable that the end passage 32 could have other cross-sectional shapes, particularly if a rod having a cross-sectional shape other than round were used. In the embodiments represented in FIGS. 3, 4, 8 and 9, the cross-sectional shape of the end passage 32 is defined by two opposing series of holes that increase in diameter toward the cavity 24, resulting in each end passage wall 36 comprising a series of steps. Each step defines a shoulder that is approximately perpendicular to the axis 33 (FIG. 3) of the end passage 32, and an edge or corner 37 that roughly defines a right angle. The nonlimiting embodiments of the housing 14 are shown in the drawings with each end passage wall 36 defined by a series of three concentric circular holes, though it is foreseeable that each end passage wall 36 could be defined by a series of coaxial holes of various other cross-sectional shapes.

The wedge member 40 can be specially fabricated for use with the housing 14. Alternatively, commercially available hardware can be used as the wedge member 40, for example, bolts that are commercially available from Dayton Superior under the SYMONS® and STEEL-PLY® line of products. The wedge member 40 represented in FIGS. 5 through 7 has oppositely-disposed longitudinal ends 42 and 44. One end 42 forms an enlarged head 46 adapted to permit the wedge member 40 to be struck with a hammer or other tool to drive the wedge member 40 into one of the side passages 22. At the opposite end 44 of the wedge member 40, a tapered region 48 is defined by a pair of ramp features 50, each defining an edge or camming surface that is not parallel to the longitudinal axis of the wedge member 40. As evident from FIG. 6, the wedge member 40 has a longitudinal length that is sufficient so that the ramp features 50 are able to enter the intersection 34 between the end passage 32 and side passages 20 when the wedge member 40 is inserted through the one of the side passages 20 of the housing 14. The wedge member 40 is further shown as having an optional abutment feature 52 that can be used to limit the extent to which tapered end 44 of the wedge member 40 can be inserted into the side passages 20 of the housing 14.

As evident from FIGS. 8 and 9, due to the tapered end 44 of the wedge member 40 and the relative cross-sectional sizes and shapes of the rod 12 and end passage 32, either ramp feature 50 of the wedge member 40 can be used to force the rod 12 into engagement with the end passage walls 36 of the end passage 32 by inserting the wedge member 40 into one of the side passages 20 of the housing 14. Furthermore, the wedge member 40 can be inserted through either side passage 20, whichever is more convenient. Because the end passage walls 36 are stepped, the ramp feature 50 engaging the rod 12 causes the rod 12 to bow and engage one or more and potentially all of the corners 37 of each end passage wall 36, which at least elastically (if not plastically) indent the rod 12 to effectively lock the rod 12 within the cavity 24 of the housing 14 (FIGS. 8 and 9).

Investigations have shown that locking the rod 12 and housing 14 in the manner depicted in FIGS. 8 and 9 is able to reliably secure and support a concrete form (not shown). When utilized with conventional rods (form ties) of the types used with concrete forms (e.g., having a cross-sectional diameter of about one-quarter inch), a particularly effective locking action has been achieved with each end passage wall 36 of the end passage 32 comprising a series of three concentric circular holes that form steps having axial lengths of about 1/32 to 1/8 inch (about 0.8 to 3.2 mm) and diameters that increase in increments of about 1/32 to 1/8 inch (about 0.8 to 3.2 mm), in other words, the diameter of each concentric hole (step) differs from each immediately adjacent concentric hole (step) by about 1/32 to 1/8 inch, with the smallest diameters (those at the endwalls 18) having diameters of greater than one-quarter inch (about 6 mm), preferably at least 5/8 inch (about 15 mm). A particularly preferred axial length for the concentric holes is about 1/8 inch (about 3.2 mm) when used in combination with hole diameters that increase in increments of about 1/16 inch (about 1.6 mm), in other words, the diameter of each concentric hole (step) differs from each immediately adjacent concentric hole (step) by about 1/16 inch. However, it should be understood that optimal dimensions for the concentric series of holes will depend on various factors, including the material and diameter of the rod 12.

As previously noted, insertion of the wedge member 40 into one of the side passages 20 and into engagement with the rod 12 can be performed with a hammer or other tool. The length of the wedge member 40 between the tapered end 44 and abutment feature 52 can be such that the tapered end 44 protrudes from the housing 14 at the sidewall 16 opposite the sidewall 16 through which the wedge member 40 was installed, which enables the wedge member 40 to be removed from the side passage 20 by striking the tapered end 44 of the wedge member 40. The housing 14 is represented as having holes 54 through which nails, screws, or other suitable fasteners can be driven to temporarily secure the housing 14 to a concrete form during installation and removal of the housing 14.

While the invention has been described in terms of specific embodiments, it is apparent that other forms could be adopted by one skilled in the art. For example, the physical configurations of the rod clamp housing and wedge member could differ from those shown, and materials and processes other than those noted could be used. Therefore, the scope of the invention is to be limited only by the following claims.

The invention claimed is:

1. A rod clamp assembly for securing a rod, the rod clamp assembly comprising:

a housing having sidewalls and endwalls, the sidewalls being arranged to define at least a first pair of sidewalls and the endwalls being arranged to define at least one pair of endwalls, the sidewalls of the first pair of sidewalls being oppositely-disposed from each other, the endwalls of the pair of endwalls being oppositely-disposed from each other, the first pair of sidewalls having a first side passage that passes entirely through the housing and defines an interior cavity within the housing, the pair of endwalls having an end passage that passes entirely through the housing and through the cavity within the housing to define an intersection with the cavity, the end passage comprising at least two end passage walls within the housing, each of the end passage walls being between the cavity and one of the pair of endwalls, the end passage having a cross-sectional shape defined at least in part by two opposing series of holes that increase in diameter toward the cavity resulting in each of the end passage walls comprising a series of steps and the end passage being larger at the intersection with the cavity than at the endwalls of the housing; and a wedge member having a first longitudinal end, an oppositely-disposed second longitudinal end, and at least a first ramp feature at the second longitudinal end that defines an edge that is not parallel to a longitudinal axis of the wedge member, the wedge member having a cross-sectional shape congruous to the cross-sectional shape of the first side passage of the housing, the wedge member having a longitudinal length that is sufficient so that the first ramp feature enters the intersection between the end passage and the first side passage when the wedge member is inserted through the first side passage of the housing.

2. The rod clamp assembly according to claim 1, wherein each step in the end passage walls defines a shoulder that is approximately perpendicular to an axis of the end passage.

3. The rod clamp assembly according to claim 2, wherein each shoulder in the end passage walls defines a right angle corner.

4. The rod clamp assembly according to claim 1, wherein each of the series of holes is a series of coaxial holes.

5. The rod clamp assembly according to claim 1, wherein each of the series of holes is a series of concentric circular holes.

6. The rod clamp assembly according to claim 1, wherein each of the steps of each of the series of holes has an axial length of about 0.8 to 3.2 mm and each of the series of holes have diameters that increase in increments of about 0.8 to 3.2 mm.

7. The rod clamp assembly according to claim 6, wherein each of the series of holes has a smallest diameter thereof greater than 6 mm at one of the endwalls.

8. The rod clamp assembly according to claim 1, wherein the cross-sectional shapes of the first side passage and the wedge member are rectangular.

9. The rod clamp assembly according to claim 1, wherein the cross-sectional shape of the end passage is circular.

10. The rod clamp assembly according to claim 1, wherein the wedge member has an enlarged head at the first longitudinal end thereof.

11. The rod clamp assembly according to claim 1, wherein the wedge member has an abutment feature between the first and second longitudinal ends thereof that limit the extent to which the wedge member can be inserted into the first side passage of the housing.

12. The rod clamp assembly according to claim 1, wherein the wedge member has a second ramp feature at the second longitudinal end that defines an edge that is opposite the first ramp feature and is not parallel to the longitudinal axis of the wedge member.

13. The rod clamp assembly according to claim 1, wherein the sidewalls of the housing further define at least a second pair of sidewalls, the sidewalls of the second pair of sidewalls being oppositely-disposed from each other, the second pair of sidewalls having a second side passage that passes entirely through the housing and has a congruous cross-sectional shape to the first side passage of the first pair of sidewalls, the first and second side passages intersecting each other to define the cavity within the housing.

14. The rod clamp assembly according to claim 1, wherein the rod is within the end passage and the rod, the end passage and the wedge member are mutually sized and shaped so that insertion of the wedge member into the first side passage causes the first ramp feature of the wedge member to engage the rod and cause the rod to bow within the cavity of the housing and engage at least one of the steps of at least one of the end passage walls to lock the rod within the cavity.

15. The rod clamp assembly according to claim 14, wherein the rod clamp assembly is installed to secure and support a concrete form.

16. A rod clamp assembly adapted to secure a concrete form, the rod clamp assembly comprising:

a rod having a cross-sectional size and shape and configured as a form tie of a concrete form;

a housing adapted to be assembled with the rod, the housing having sidewalls and endwalls disposed transverse to the sidewalls, the sidewalls being arranged to define at least first and second pairs of sidewalls and the endwalls being arranged to define at least one pair of endwalls, the sidewalls of the first pair of sidewalls being oppositely-disposed from each other, the sidewalls of the second pair of sidewalls being oppositely-disposed from each other, the endwalls of the pair of endwalls being oppositely-disposed from each other, each of the first and second pairs of sidewalls having a side passage that passes entirely through the housing, the side passages having congruous cross-sectional shapes and intersecting each other to define an interior cavity within the housing, the pair of endwalls having an end passage that passes entirely through the housing and through the cavity within the housing to define an intersection with the cavity, the end passage comprising two end passage walls within the housing, each of the end passage walls being between the cavity and one of the pair of endwalls, the end passage having a cross-sectional size and shape defined by two opposing series of holes that increase in diameter toward the cavity resulting in each of the end passage walls comprising a series of steps and the end passage being larger at the intersection with the cavity than at the endwalls of the housing; and a wedge member having a first longitudinal end, an oppositely-disposed second longitudinal end, and at least a first ramp feature at the second longitudinal end that defines an edge that is not parallel to a longitudinal axis of the wedge member, the wedge member having a cross-sectional shape congruous to the cross-sectional shapes of the side passages of the housing, the wedge member having a longitudinal length that is sufficient so that the first ramp feature enters the intersection between the end passage and one of the side passages when the wedge member is inserted through the one of the side passages of the housing.

17. The rod clamp assembly according to claim 16, wherein each of the series of holes is a series of coaxial holes.

18. The rod clamp assembly according to claim 16, wherein each of the series of holes is a series of concentric circular holes.

19. The rod clamp assembly according to claim 16, wherein each of the steps of each of the series of holes has an axial length of about 0.8 to 3.2 mm and each of the series of holes have diameters that increase in increments of about 0.8 to 3.2 mm.

20. A method of using the rod clamp assembly of claim 16, the method comprising installing the rod clamp assembly to secure and support a concrete form.

* * * * *